US005951144A

United States Patent [19]

Gavigan et al.

[11] Patent Number: 5,951,144

[45] Date of Patent: Sep. 14, 1999

[54] LOW VOLTAGE LIGHTING SYSTEM

[76] Inventors: Mark Gavigan; Lloyd Gavigan, both of c/o 2093 Jetstream Road, London, Ontario, Canada, N5V 4M7

[21] Appl. No.: 08/925,645

[22] Filed: Sep. 9, 1997

[30] Foreign Application Priority Data

Sep. 11, 1996 [CA] Canada ..... 2185288

[51] Int. Cl.[6] ..... F21S 1/02

[52] U.S. Cl. ..... 362/153; 362/153.1; 362/145; 362/365

[58] Field of Search ..... 362/152, 153, 362/153.1, 364, 365, 145

[56] References Cited

U.S. PATENT DOCUMENTS

| | | | |
|---|---|---|---|
| 640,140 | 12/1899 | Lloyd | 362/153 |
| 1,586,361 | 5/1926 | Gaffney . | |
| 1,801,962 | 4/1931 | Kerr . | |
| 4,570,207 | 2/1986 | Takahashi et al. | 362/152 |
| 4,744,014 | 5/1988 | Harris | 362/145 |
| 5,006,967 | 4/1991 | Diamond | 362/147 |
| 5,095,412 | 3/1992 | French | 362/153 |
| 5,105,347 | 4/1992 | Ruud et al. | 362/300 |
| 5,160,202 | 11/1992 | Legare | 362/153.1 |
| 5,317,833 | 6/1994 | Goldman | 47/33 |
| 5,390,090 | 2/1995 | Nau | 362/153.1 |
| 5,678,920 | 10/1997 | Kerr | 362/145 |

*Primary Examiner*—Thomas M. Sember
*Attorney, Agent, or Firm*—Martin J. Marcus

[57] ABSTRACT

A novel low voltage lighting system is provided herein, by the following novel combination of elements. The first element is a brick, the brick having a bore therethrough, the bore having an upper countersunk enlargement. The second element is a lighting fixture installed in the brick. The lighting fixture includes a base, the base including an upper circular platform surrounded by a perimetrical wall which is capped by a base-component of a mating snap-ring assembly. A central well depends from the circular platform, the well being enclosed by a generally-cylindrical boss. The central well communicates with a depending, hollow, rectangular parallelepiped member which is provided with a pair of longitudinally-extending openings for the passage of a pair of electrical wires. The depending, hollow, rectangular parallelepiped member is fitted with a standard wiring harness for insertion of a low voltage light bulb thereinto. The generally-cylindrical boss serves the dual function of accommodating the standard wiring harness therein, and its outer cylindrical surface frictionally-engages the bore through the brick to secure the lighting fixture to the brick. The lighting fixture also includes a circular lens cap which is provided with a cap-component of the mating snap-ring assembly for selective frictional engagement and disengagement with the base-component of the mating snap-ring assembly.

14 Claims, 1 Drawing Sheet

LOW VOLTAGE LIGHTING SYSTEM

BACKGROUND OF THE INVENTION

The invention relates to a dissassemblable low voltage lighting system.

(a) Field of the Invention

In the landscaping arts, it is customary to delineate flower beds, lawns and pathways with masonry edgings made from a series of bricks, masonry blocks or a combination of edging elements cast out of cement. The installation of those types of edgings requires considerable time and a variety of building elements, as well as some masonry skills.

It has been found that there was a need for a low-voltage lighting system which nay be used in-ground, flush-to-surface mounting, or for vertical wall marking; which may be used as security/safety and exit lighting along driveways, walk-ups, curb-cuts, and stairs for commercial or residential construction; which may be used as safety lighting for office and industrial buildings, historical monuments and apartment buildings or private homes; which may be used as directional lighting for parking entranceways, spacing stairwells, and theatre lines; which may be used to decorate driveways, sidewalks, steps, swimming pool borders or patios; and which may be used as directional guiding lighting or accent lighting to improve landscape design.

(b) Description of the Prior Arts

An illuminating device is now known which included an inverted V-shaped cover which was made of transparent plastic and which was adapted to house illuminating means. The cover projected light upwardly over a complete 180 degree angle and was bolted on the surface of a flat driveway.

Another illuminated safety curbing is now known which included a plastic cover which was mounted on a rigid base structure which was adapted to be bolted above a flat surface.

Still another such device which is now known was a traffic signal which included a recess in a sidewalk at a street intersection. Illuminating means were provided to project light on colored lenses which closed the recess.

Heretofore, glass block construction units, formed into wall panels were never self-illuminated, but instead allowed light to pass through the glass block unit from a source exterior to the glass block unit. Natural day-lighting, or an electrical source of light entered through one side of the glass block unit and exited through the other remaining side. To provide interesting special effects, designers have called for neon lights, or other electric lighting devices to be installed independently behind a wall of glass block. These prior art uses of electric lighting required their own form of support, so that in essence, the glass block wall and the electric lighting were abutted adjacent to each other, often in a crowded installation, whereby it was difficult to service the electric lighting adjacent to the glass block wall.

The type of electric light chosen to illuminate the glass block wall, had its own inherent shape. For example, neon lights were usually provided in long narrow tubes of light, or fluorescent tubes in a somewhat larger format, but also long narrow tubes, and so these shapes of lighting fixtures were visible through the glass block wall, creating hot spots thus betraying their hybrid nature, as separate from the glass block and therefore not coordinating aesthetically with the rectilinear, cellular nature of a glass block wall, Therefore in the prior art a long felt need to provide an aesthetic and efficient luminous wall has existed unfulfilled.

Also in the prior art, luminaries were known in which the glass lamp portion of the device was permanently fused to the electrical device portion of the luminaries. Such glass lamp portion was wastefully thrown away when the electrical device was spent, even though the glass lamp was still usable.

Low voltage lighting systems have been well known for a number of years and have been used for decorations of buildings, illumination of steps, and the like. In such installations, the lighting system was installed and secured within the structures after the structures had been built. In one such system, which was primarily designed for illuminating stairways, the lighting system was permanently secured within an area beneath the overhanging edge of each step, with the steps specifically constructed so as to accommodate the lighting apparatus. As will be obvious, this particular apparatus is quite labour intensive, in that it is designed solely for installations in buildings and the like after the structure was completed.

The patent art is replete with a variety of such devices.

One such illuminated device was provided by U.S. Pat. No. 1,586,361, patented May 25, 1920 by Joseph M. Gaffney. Such patented device displayed house numbers particularly at or near the curb in front of a house, and included a housing and a cover therefor. The housing was adapted to be permanently set adjacent the curb of a street in proximity to a house. Illuminable numbers were provided in the cover. Electric bulbs were provided within the housing and in the electric circuit, and a switch was provided in the circuit. The cover had a number of apertures, each with a perimetrical ledge, with number-indicating means in each aperture comprising a transparent plate, a non-transparent plate on top of the transparent plate and an opening in the non-transparent plate in the form of a number. Colored transparent material was provided in the opening of each non-transparent plate.

Another such illuminated device was a marker post provided by U.S. Pat. No. 1,801,962, patented Apr. 21, 1931 by Frank D. Kerr. The patented marker post included a hollow body portion providing a chamber having an open body portion, a designation element mounted in the holder, and a plurality of transparent members having faceted outer faces, which were embedded in the body portion. A receptacle was mounted in the front wall of the latter and extended into the chamber. An illuminating element was mounted in the chamber and was supported by the receptacle for illuminating the holder and the transparent elements.

Yet another luminous device was provided in U.S. Pat. No. 4,570,207, patented Feb. 11, 1996, by Hisae Takahashi, et al. That luminous indicating device included at least one luminous block which was adapted to be buried in a road surface so that a radiating surface thereof was flush with the road surface. The luminous block was formed of a composite material block and at last one luminous element which was formed of a transparent material block and a light source buried at one end portion of the block to radiate light from the other end surface of the block. The luminous block was buried in the composite material block so that the other end surface of the material block was flush with a top surface of the composite material block.

Still another low voltage lighting system was provided in U.S. Pat. No. 4,744,014, patented May 10, 1988 by Edward H. Harris. That low voltage lighting system included at least one stepping stone, and, preferably, a series of stepping stones, with each stepping stone having at least one recessed channel in the upper face thereof, and a light source removably inserted within the recessed channel. The light source comprised a flexible, substantially transparent tube and low voltage lights within the tube. Means were disclosed for connecting the light source to a power source in a selective or predetermined manner.

Still another such illuminating device was provided by U.S. Pat. No. 5,006,967, patented Apr. 9, 1991 by Gary Diamond. That device included a glass block construction unit assembly having all faces made of glass forming a chamber, with an electric light means assembly integral with the glass block unit. The electric light means assembly penetrated through a wall of the glass block unit, and was removable from the glass block unit. Electrical conductors were connected to the electric light means being located at the exterior of the glass block unit. The construction unit assembly thereby formed a self-illuminating glass block construction unit.

A still further such illuminating device was provided by U.S. Pat. No. 5,095,412, patented Mar. 10, 1992 by Stephen French. That device included a generally-rectangular wooden panel having a plurality of first apertures extending into the panel from a first face of the panel, and a plurality of second apertures extending into the panel from a second face of the panel opposed to the first face. The second plurality of apertures was located to intersect a corresponding first aperture. A plurality of illumination devices were each located in one of the first apertures so as to be visible through the corresponding second face of the panel. Electrical connection means conveyed electrical power to the illumination devices from the direction of the first face of the panel.

Yet a further such illuminating device was provided in U.S. Pat. No. 5,160,202, patented Nov. 3, 1992 by Luc R. Légaré. That device was an illuminated concrete curbstone block for driveway curbing which was adapted to be partly immersed in the ground adjacent the driveway. The prismatic concrete block had a top face, a rear face, a front face and two lateral faces. A portion of the rear, front and lateral faces emerged above the ground. A housing was located inside the block adjacent the top face. The housing formed a transparent rigid window aligned with the front face and preferably receding therefrom. The window was adapted to lie at the level above the ground. A lighting means, by way of electrical wires coming from outside the block, was provided in the housing, the lighting means including a reflector for projecting the light from the lighting means through the window. An open channel extended downwardly from the housing to the rear face for allowing the wires to pass therethrough and for letting the wires extend outside the block at a level above the ground. The open channel also allowed air circulation therethrough. The illuminated curbstone was adapted to project light onto the driveway at a level above the ground and the channel was adapted to allow air penetration into the housing. The lateral faces of the curbstone were provided with a vertical rib and a vertical corresponding groove. The rib was adapted to fit into the groove of an adjacent curbstone for preventing edgewise displacement of two adjacent curbstones. The curbstone could have a dome-shaped portion located over the housing with a reflector being located inside the housing for projecting the light of the lighting means in the direction of a window.

A further such device was provided by U.S. Pat. No. 5,317,833 patented Jun. 7, 1994 by R. I. Goldman which provided imitation bricks made of moulded plastic. The block could be traversed by a section of an illuminating strip having bulbs disposed at regular intervals therealong, in which case the block was made of translucent material.

SUMMARY OF THE INVENTION

(a) AIMS OF THE INVENTION

Nevertheless, there is still a need for a more efficient medium for creating effective and aesthetically pleasant borders between flower beds, lawns and garden paths. It is therefore an object of the present invention to provide a lighting fixture for a low voltage lighting system.

Another object of this invention is to provide such a low voltage lighting system.

(b) STATEMENT OF THE INVENTION

This invention, in one broad embodiment, therefore now provides a lighting fixture for a low voltage, flush-mountable lighting system. The lighting fixture comprises a base, the base comprising an upper circular platform which is surrounded by a perimetrical wall which is capped by a base-component of a mating snap-ring assembly, a central well depending from the circular platform, the well being enclosed by a generally-cylindrical boss, a depending, hollow, rectangular parallelepiped extension communicating with the central well, the extension being provided with a pair of longitudinally-extending openings to provide for passage of a pair of electrical wires therethrough, the depending, hollow, rectangular parallelepiped member being fitted with a standard wiring harness, for the insertion therein of a low voltage light bulb the generally-cylindrical boss being hollow to serve one purpose accommodating a standard wiring harness therein, and the generally-cylindrical boss having an outer cylindrical surface serving a second purpose of frictionally-engaging a bore in a brick to secure the lighting fixture to the brick; and a circular lens cap which includes a cap-component of the mating snap-ring assembly for selective frictional engagement and disengagement with the base-component of the mating snap-ring assembly.

This invention, in another broad embodiment, therefore also now provides a low voltage lighting system comprising, in combination: a brick, the brick having a bore therethrough and an upper countersunk enlargement; and a lighting fixture installed in the brick, the lighting fixture comprising: a base, the base comprising an upper circular platform which is surrounded by a perimetrical wall capped by a base-component of a mating snap-ring assembly, a central well depending from the circular platform, the well being enclosed by a generally-cylindrical boss, a depending, hollow, rectangular parallelepiped extension, the generally-cylindrical boss being hollow to serve one purpose of accommodating a standard wiring harness therein, and the generally-cylindrical boss having an outer cylindrical surface serving a second purpose of frictionally-engaging the bore in a brick to secure the lighting fixture to the brick provided with a pair of longitudinally-extending openings to provide for passage of a pair of electrical wires, the depending, hollow, rectangular parallelepiped member being fitted with a standard wiring harness for insertion of a low voltage light bulb the generally-cylindrical boss being hollow to serve one purpose accommodating a standard wiring harness therein, and the generally-cylindrical boss having an outer cylindrical surface serving a second purpose of frictionally-engaging a bore in a brick to secure the lighting fixture to the brick thereinto, and a transparent or translucent circular lens cap, which is provided with a cap-component of the mating snap-ring assembly, the lens cap being snap-fitted to the base.

(c) OTHER FEATURES OF THE INVENTION

By one feature of the lighting fixture of this invention, the base-component of the mating snap-ring assembly comprises a peripheral flange extending across the upper circular platform and further extending downwardly from a top thereof along the perimetrical wall.

By another feature of the lighting fixture of this invention, the cap-component of the mating snap-ring assembly comprises a circular lip extending downwardly from the circular lens cap, the lip including an inwardly-facing perimetrical flange.

By yet another feature of the lighting fixture of this invention the base-component of the mating snap-ring assembly comprises a peripheral flange extending across the upper circular platform and extending downwardly from a top thereof along the perimetrical wall; and the cap-component of the mating snap-ring assembly comprises a circular lip extending downwardly from the circular lens cap, the lip including an inwardly-facing perimetrical flange.

By another feature of this feature of the lighting fixture of this invention, the snap-ring comprises the peripheral flange of the base which is snapped into a space between a lower face of the lens cap and an upper face of the perimetrical flange.

By still another feature of the lighting fixture of this invention, the cylindrical base is provided with a plurality of peripheral, longitudinally-extending ribs.

By still further features of the lighting fixture of this invention, the lighting fixture may be made of high-density polyethylene, or may be made of polypropylene, or may be made of polycarbonate, or may be UV-proofed, or may be provided in a plurality of colors, or may be both UV-proofed and be provided in a plurality of colors.

By one feature of the low voltage lighting system combination of this invention, the base-component of the mating snap-ring assembly includes a peripheral flange extending across the upper circular platform and extending downwardly from a top thereof along the perimetrical wall, the cap-component of the mating snap-ring assembly includes a circular lip extending downwardly from the circular lens cap, the lip includes an inwardly-facing perimetrical flange, and the snap-ring assembly comprises the peripheral flange of the base which is snapped into a space between a lower face of the lens cap and an upper face of the perimetrical flange.

By another feature of the low voltage lighting system combination of this invention, the cylindrical boss is provided with a plurality of peripheral, longitudinally-extending gripping ribs, the ribs engaging the inner periphery of the bore through the brick to enhance frictional engagement between the bore in the brick and the outer cylindrical surface of the generally-cylindrical boss.

By yet another feature of the low voltage lighting system combination of this invention, the base rests within the countersunk enlargement with an upper surface thereof flush with an upper surface of the brick, and with the lip of the lens cap accessible around the periphery of the counter bore.

By a feature of this feature of the low voltage lighting system combination of this invention, the low voltage lighting system is fitted with a low wattage, wedge base bulb.

By yet another feature of this feature of the low voltage lighting system combination of this invention, the system includes a step-down transformer which is connectable to a standard 110 v receptacle.

DESCRIPTION OF PREFERRED EMBODIMENTS

(a) BRIEF DESCRIPTION OF THE DRAWINGS

In the accompanying drawings.

Figure 1:
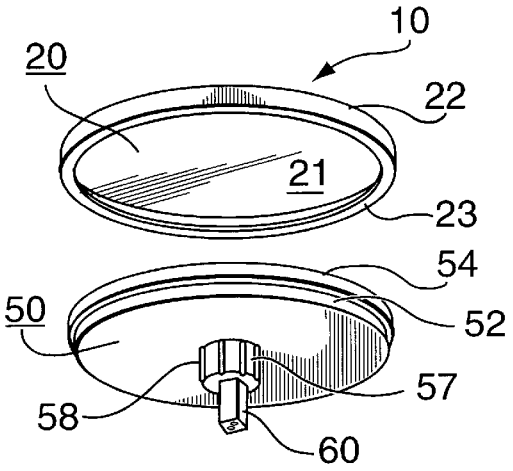
FIG. 1 is a disassembled, exploded, isometric view of the lighting fixture for the low voltage lighting system of one embodiment of this invention.

(b) DESCRIPTION OF FIG. 1

As seen in FIG. 1, the lighting fixture comprises a generally-cylindrical transparent or translucent lens cap 20 and a generally-cylindrical base 50.

Figure 2:
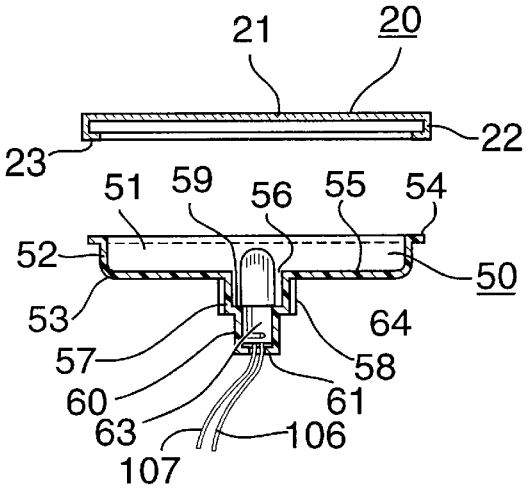
FIG. 2 is a central, longitudinal section through the disassembled lighting fixture as depicted in FIG. 1.
Figure 3:
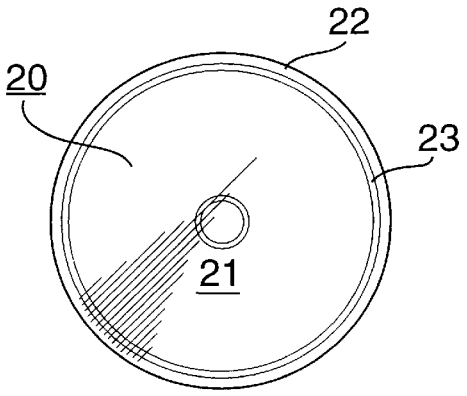
FIG. 3 is a top plan view of the lens cap of the lighting fixture embodiment of FIG. 1.

(c) DESCRIPTION OF FIG. 2 AND FIG. 3

As seen more clearly in FIG. 2 and FIG. 3, the lens cap 20 is a circular member 21, which is provided with a depending cylindrical rim 22 and an in-turned peripheral flange 23.

Figure 4:
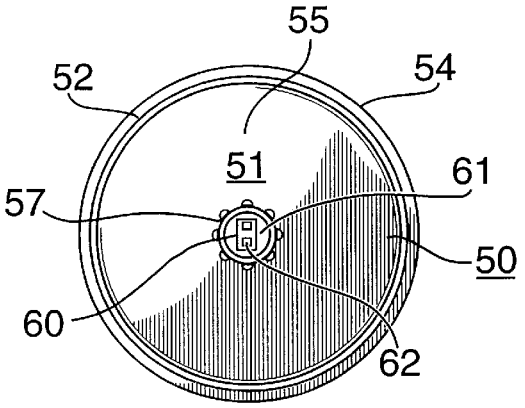
FIG. 4 is a top plan view of the base of the lighting fixture of FIG. 1.

(d) DESCRIPTION OF FIG. 2 AND FIG. 4

As seen in FIGS. 2 and 4, the base 50 is a shallow, generally-hollow cylinder 51 having cylindrical walls 52 and a rounded lower periphery 53. The upper peripheral edge of wall 52 is provided with an outward circular flange 54. The central area of lower floor 55 of the shallow, hollow cylinder 51 is provided with a hollow well 56 providing an external cylindrical boss 57. Boss 57 is provided with a plurality of spaced-apart, vertically-extending ribs 58. The lower floor 59 of hollow well 56 leads to a hollow, rectangular parallelepiped extension 60 the lower floor 61 of which is provided with a pair of openings 62.

Figure 5:
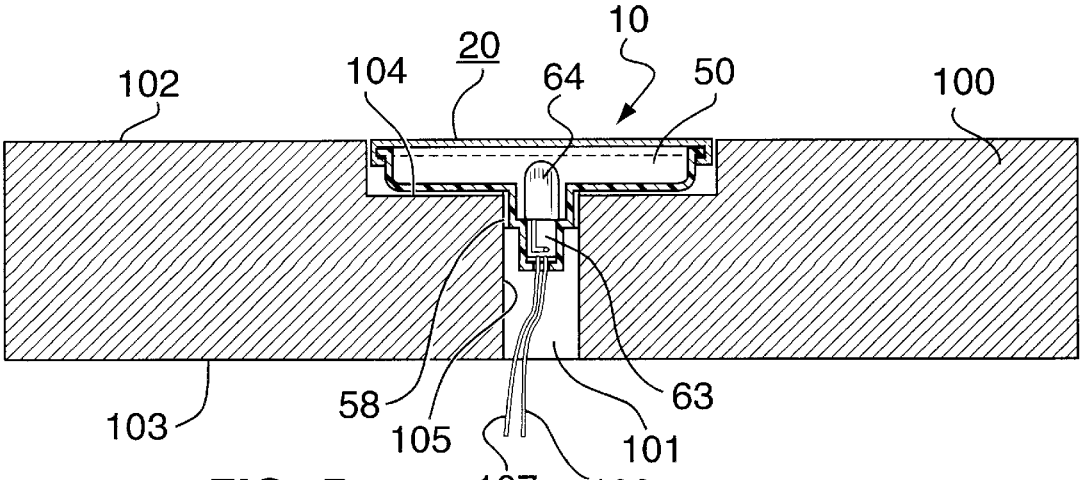
FIG. 5 is a central longitudinal cross-section of a low voltage lighting system of another embodiment of this invention fitted with an assembled lighting fixture of the embodiment of FIG. 1.

(d) DESCRIPTION OF FIG. 5

In its assembled form as shown in the low voltage lighting system of FIG. 5, the hollow, rectangular parallelepiped extension 60 is fitted with the conventional bulb harness 63. A conventional standard low voltage (i.e., 4, 7, 11, or 16 watt) wedge base bulb 64, similar to an automotive bulb, is plugged into the bulb harness 63. The lens cap 20 is then snap-fitted to the base 50 by cooperation between the rim 22/flange 23 of the lens cap 20 and the flange 54 of the base 50.

As more clearly seen in FIG. 5, the brick 100 is provided with a bore 101 between its upper surface 102 and its lower surface 103. The bore 101 at the upper surface 102 is provided with a countersunk enlargement 104. The shallow, hollow cylinder 51 of the base 50 sits within the countersunk enlargement 104. The longitudinally-extending ribs 58 fictionally contact the inner wall 105 of the bore 101 to hold the lighting fixture 10 with the bore 101 in the brick 100. Electrical wires 106, 107 (See also FIG. 2) lead to the bulb harness 63.

(e) OPERATION OF THE INVENTION

A plurality of such bricks are adapted to be fitted together to provide the desired delineation of flower beds, lawns and pathways as security/safety and exit lighting along driveways, walk-ways, curb-cuts, and stairs in commercial or residential construction; as safety lighting for office and industrial buildings, historical monuments and apartment buildings or private homes; as directional lighting for parking entranceways, spacing stairwells, and theatre lines; decoration of driveways, sidewalks, steps, swimming pool borders or patios or as directional guiding lighting or accent lighting to improve landscape design. Once the low voltage lighting in bricks 100 is connected in series, the wires are connected to a stepdown transformer (not shown) which may be plugged into an indoor or outdoor electrical outlet.

The lighting fixture of the low voltage lighting system of this invention is made of one of the strongest synthetic plastics materials, e.g., high density polyethylene, polypropylene or polycarbonate, so that it can be driven by cars and trucks. The lens cap is made of durable transparent or translucent synthetic plastic which keeps it from shattering. The light is provided by a standard wedge base bulb similar to an automotive bulb which, for a 4 watt bulb, would have a life expectancy of 1000–2000 hours. The low voltage lighting system of this invention is connected to an outside step-down transformer which is then plugged into a standard 110 V outdoor receptacle. The low voltage lighting system of this invention is durable and withstands pedestrian and vehicle weight, It is adaptable to any climate or weather since snow and ice melt off easily. It is easy to install and service. In order to change a bulb it is only necessary to remove the lens cap, change the bulb and snap the lens cap back in place.

The present invention is not directed to permanent lighting installations within buildings, but is directed to a unique means for lighting around the exterior buildings or within interior gardens, landscape and the like. Further, the device is manufactured such that the low voltage lighting elements are placed therewithin and are easily removable for repair or replacement.

CONCLUSION

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

We claim:

1. A lighting fixture for a low voltage lighting system comprising:

(I) a base, said base comprising:

(a) an upper circular platform which is surrounded by a perimetrical wall which is capped by a base-component of a mating snap-ring assembly;

(b) a central well depending from said circular platform, said central well being enclosed by a generally-cylindrical boss, (c) a depending, hollow, rectangular parallelepiped extension communicating with said central well, said extension being provided with a pair of longitudinally-extending openings to provide for passage of a pair of electrical wires therethrough, said depending, hollow, rectangular parallelepiped extension being fitted with a standard wiring harness, for the insertion therein of a low voltage light bulb; said generally-cylindrical boss being hollow to serve one purpose of accommodating said standard wiring harness therein, and said generally-cylindrical boss having an outer cylindrical surface serving a second purpose of frictionally-engaging a bore in a brick to secure said lighting fixture to said brick; and (II) a circular transparent or translucent lens cap, said cap including a cap-component of a mating snap-ring assembly for selective frictional engagement and disengagement with said base-component of said mating snap-ring assembly.

2. The lighting fixture of claim 1, wherein said base-component of said mating snap-ring assembly includes a peripheral flange extending across said upper circular platform and extending downwardly from a top thereof along said perimetrical wall.

3. The lighting fixture of claim 1, wherein said cap-component of said mating snap-ring assembly includes a circular lip extending downwardly from said circular lens cap, said lip including an inwardly-facing perimetrical flange.

4. The lighting fixture of claim 1, wherein said base-component of said mating snap-ring assembly includes a peripheral flange extending across said upper circular platform and extending downwardly from a top thereof along said perimetrical wall; wherein said cap-component of said mating snap-ring assembly includes a circular lip extending downwardly from said circular lens cap, said lip including an inwardly-facing perimetrical flange; and whereby said snap-ring assembly comprises said peripheral flange of said base which is snapped into a space between a lower face of said lens cap and an upper face of said perimetrical flange.

5. The lighting fixture of claim 1, wherein said cylindrical base is provided with a plurality of peripheral longitudinally-extending ribs, said ribs engaging the inner periphery of said bore through said brick, to enhance frictional engagement between said bore in said brick and said outer cylindrical surface of said generally-cylindrical boss.

6. The lighting fixture of claim 1, which is made of high-density polyethylene, or of polypropylene, or of polycarbonate.

7. The lighting fixture of claim 6, wherein said lens cap is UV-proofed.

8. The lighting fixture of claim 6, wherein said lens cap is UV-proofed, and further wherein said lens cap is provided in a plurality of different colors.

9. A low voltage lighting system comprising, in combination:

(A) a brick, said brick having a bore therethrough and an upper countersunk enlargement;and (B) a lighting fixture installed in said brick, said lighting fixture comprising:

(I) a base, said base comprising:

(a) an upper circular platform which is surrounded by a perimetrical wall which is capped by a base-component of a mating snap-ring assembly;

(b) a central well depending from said circular platform, said central well being enclosed by a generally-cylindrical boss, (c) a depending, hollow, rectangular parallelepiped extension communicating with said central well, said extension being provided with a pair of longitudinally-extending openings to provide for passage of a pair of electrical wires therethrough, said depending, hollow, rectangular parallelepiped extension being fitted with a standard wiring harness for insertion therein of a low voltage light bulb, said generally-cylindrical boss being hollow to serve one purpose of accommodating said standard wiring harness therein, and said generally-cylindrical boss having an outer cylindrical surface serving a second purpose of frictionally-engaging a bore in a brick to secure said lighting fixture to said brick; and (II) a transparent or translucent circular lens cap, which includes a cap-component of said mating snap-ring assembly, said lens cap being snap-fitted to said base.

10. The low voltage lighting system of claim 9, wherein said base-component of said mating snap-ring assembly includes a peripheral flange extending across said upper circular platform and extending from a top thereof downwardly along said perimetrical wall; wherein said cap-component of said mating snap-ring assembly includes a circular lip extending downwardly from said circular lens cap, said lip including an inwardly-facing perimetrical flange; and whereby said snap-ring assembly comprises said peripheral flange of said base which is snapped into a space between a lower face of said lens cap and an upper face of said perimetrical flange.

11. The low voltage lighting system of claim 9, wherein said cylindrical boss is provided with a plurality of peripheral, longitudinally-extending gripping ribs, said ribs engaging the inner periphery of said bore through said brick, to enhance frictional engagement between said bore in said brick and said outer cylindrical surface of said generally-cylindrical boss.

12. The low voltage lighting system of claim 9, wherein said base rests within said countersunk enlargement with an upper surface thereof substantially-flush with an upper surface of said brick, and with a lip of said lens cap accessible around the periphery of said countersunk enlargement.

13. The low voltage lighting system of claim 9, which is fitted with a low wattage, wedge base bulb.

14. The low voltage lighting system of claim 9, including a step-down transformer connectable to a standard 110 V receptacle.

* * * * *